United States Patent [19]

Wilson, Jr.

[11] Patent Number: 4,788,840

[45] Date of Patent: Dec. 6, 1988

[54] BUNG PLUG LOCKING DEVICE

[76] Inventor: Donald J. Wilson, Jr., 2206 Wheeler St., Woodridge, Ill. 60517

[21] Appl. No.: 100,424

[22] Filed: Sep. 24, 1987

[51] Int. Cl.[4] ..... B65D 55/14

[52] U.S. Cl. ..... 70/164; 29/434; 29/525.1; 70/230; 220/210; 220/315

[58] Field of Search ..... 70/229, 230, 163, 164, 70/158, 170, 165, 177, 461; 29/434, 526 R; 220/210, 315; 411/910, 96

[56] References Cited

U.S. PATENT DOCUMENTS

| | | | |
|---|---|---|---|
| 790,142 | 5/1905 | Lichetti | 70/DIG. 56 X |
| 1,208,236 | 12/1916 | Thompson et al. | 70/230 |
| 1,615,987 | 2/1927 | Loewer | 70/170 |
| 1,650,578 | 11/1927 | Wyman | 70/164 |
| 1,656,686 | 1/1928 | Tjepkes | 70/170 |
| 1,711,535 | 5/1929 | Leet | 70/164 |
| 1,762,582 | 6/1930 | Nunes | 70/170 |
| 1,804,678 | 5/1931 | Duffy | 70/230 |
| 1,806,124 | 5/1931 | Smith | 70/158 |
| 1,812,826 | 6/1931 | Frick | 70/164 |
| 1,814,343 | 7/1931 | Smith | 70/230 |
| 1,825,726 | 10/1931 | Gredell | 70/164 |
| 2,297,579 | 9/1942 | Norberg | 70/164 |
| 2,556,900 | 6/1951 | Buschhovn | 70/230 |
| 2,693,691 | 11/1954 | Pasanen | 248/552 X |
| 3,263,881 | 8/1966 | Wooten | 70/230 |
| 3,498,400 | 3/1970 | Hysmith | 70/230 |
| 3,729,963 | 5/1973 | Hintz | 70/230 |
| 3,752,254 | 8/1973 | Carley et al. | 70/230 X |
| 4,426,863 | 1/1984 | Gillette et al. | 70/164 |
| 4,562,707 | 1/1986 | Graham, III | 70/230 X |
| 4,655,060 | 4/1987 | Jakubas | 70/230 |

FOREIGN PATENT DOCUMENTS

| | | | |
|---|---|---|---|
| 389215 | 1/1924 | Fed. Rep. of Germany | 70/164 |
| 506328 | 8/1920 | France | 70/226 |

*Primary Examiner*—Lloyd A. Gall

*Attorney, Agent, or Firm*—Aubrey L. Burgess

[57] ABSTRACT

A drum locking device which comprises a telescoping locking bar means, one end of which fits into locking relationship with one of a pair of lugged closure members and the other end of which fits over the other of said pair of lugged closure members, and a lock securing the device to prevent removal of the contents of the drum.

14 Claims, 2 Drawing Sheets

BUNG PLUG LOCKING DEVICE

FIELD OF THE INVENTION

This invention relates to a locking device for bung plugs in a container, such as a drum containing chemicals and the like.

BACKGROUND OF THE INVENTION

Drums containing petroleum products, various chemicals, and other liquids and materials, some of which may be corrosive, or toxic and thus a health hazard, are usually provided with a bung hole and a vent hole in their top covers. These holes are usually plugged with a bung and a vent closure, both threadably received in the respective holes to prevent leakage of the contents from the drums. To prevent contamination of the contents of the drums, and/or, the removal of the contents therefrom, locking means have been used to lock the bung and vent closures against removal.

DESCRIPTION OF PRIOR ART

U.S. Pat. No. 4,655,060, to Jakubas, relates to a locking device for drums which includes a pair of caps, one for the bung hole and one for the vent hole, each cap having an opening therethrough and a swivel arrangement for alignment of the openings therein. After threading the caps into their respective holes, the openings are aligned and a locking bar with a flanged end is passed through the cap's opening, the flanged end forming a stop for that end of the bar. The shackle of a padlock is passed through an opening in the bar which is at the opposite end thereof from the flange and which extends beyond the cap, and the padlock is locked.

The caps are constructed of several pieces to permit the swiveling thereof, including a spring means; a costly construction. The springs are subject to corrosion and failure due to fatigue.

BRIEF DESCRIPTION OF THE INVENTION

According to the present invention, the bung plug and vent plug of a drum, constructed of either metal, such as steel, or plastic, are replaced with threaded lugged closure members, i.e., flanged top threaded members with upstanding lugs, each of which is substantially identical to the other. The lugs are formed with an opening therethrough in the shape of a slotted circle, as will be explained in detail later and which is clearly illustrated in the drawings. In many drums, the bung is larger in diameter than the vent plug, so that a threaded adapter is used to receive the lugged closure members. In other drums, both the bung and vent plugs are the same diameter. In any event, the lugged closure members, as used in this invention, are substantially identical, and when adapters are used, they are provided with a threaded cavity of the same size and threads as the lugged closure members. Generally, a gasket surrounds the threaded portion of the lugged closure members and is positioned closely adjacent the flange. The adapters are usually constructed of a plastic, but they can be constructed of metal.

Once the bung hole closure member with, when necessary, an adapter, and the vent hole closure member (with an adapter if necessary) are screwed into their respective holes and tightened so as to seal the drum's contents, a locking bar means is provided to engage the closure member lugs. The shackle of a padlock is passed through the opening in one of the lugs and the padlock is locked to lock the bung hole and vent hole closure members against removal from the drum.

The locking bar means is unique, being a pair of generally flat and substantially identical bars, each having a width greater than the diameter of the circular portion of the openings in the lugs and a cross-section slightly smaller than that of the slotted portion of the openings through the lugs. Each bar has a slotted, flanged end and a spade-like end, the latter having one or more reduced width portions closely adjacent the spade-like end of the bar and an elongated opening therethrough which can be generally uniform in width or in the shape of a bow tie, or a figure eight or an opening defined by a reduced waist. The bars are assembled so that each passes through the slot of the other, thus providing a telescoping locking bar means whereby its length can be adjusted to accommodate different bung and vent hole spacings. Because of this feature, the locking device of this invention is usable for drums of various sizes and capacities, for example the 55 gallon drum as well as the 15 gallon drum.

By turning the assembled bar means from a flat position to an angle approching 90 degrees from the flat, the spaded end of one of the bars is passed through the opening of one of the upstanding lugs, so that the reduced width portion is aligned with the lug's opening. When the bar means is turned back to the flat, the bar means is locked with respect to that lug. The bar means is adjusted for closure spacing and the opening at the other end of the bar means is then passed over the other lug. The bow tie or figure eight opening permits the assembly of the locking bar over the lug even though the lug is acutely angled with respect to the length of the bar means. The shackle of a padlock is passed through that lug's opening and locked so that the bar means cannot be removed from the lugs. Thus the closure members are locked in their respective holes and the drum's contents are safe from removal and contamination, as the case may be.

The bars forming the locking bar means are also formed with end portions at their flanged ends which are so dimensioned and shaped to be usable as wrenches to remove the usual bung and vent plugs. Each plug is generally formed with a slotted head or with stops defining a slot which are adapted to be engaged by a wrench and the like, so that the bung and vent plugs can be tightened when the drum is originally filled with its contents. Another feature of this invention is the ability to use a locking bar as a wrench or lever when inserting, tightenting, or removing the replacement closure means by inserting the spade-like end portion of a bar through a lug hole or placing the bar's opening over a lug, and turning the bar as necessary.

DETAILED DESCRIPTION OF THE PREFERRED EMBODIMENTS

Figures 1, 2, 3, 4:
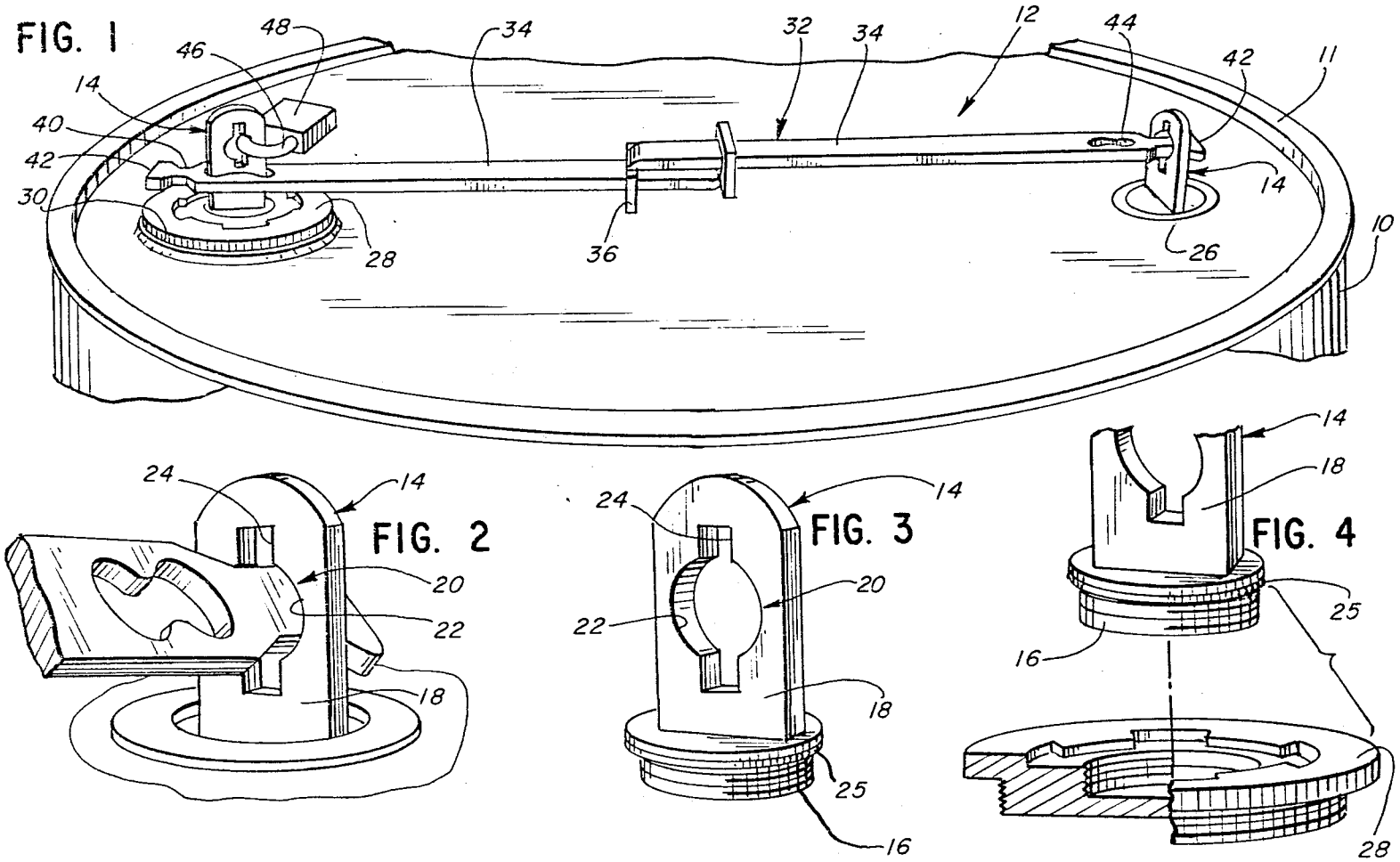
FIG. 1 is an illustration showing the locking device of this invention in use.
FIG. 2 is an enlarged partial illustration of a locking bar means inserted into an opening of a lugged closure member.
FIG. 3 is an illustration of a lugged closure member.
FIG. 4 is an illustration of an adapter closure member and a portion of a lugged closure member to be received therein.

Looking now at the drawings, there is illustrated in FIG. 1, a drum 10 having a cover 11 with the locking device 12 of this invention. The locking device 12 comprises a pair of substantially identical lugged closure members 14 (see also FIGS. 2 to 4), each having a flanged threaded part 16 and an upstanding lug 18, the lug 18 having an opening 20 formed by a circular part 22 and a slot part 24. A resilient gasket 25 surrounds the flanged threaded part 16. As illustrated, one of the closure members 14 is threadably received in a threaded vent opening 26 and the other closure member is threadably received in a threaded bung adapter 28, the latter being threadably received in a bung hole 30. In the event the vent opening is the same diameter as the bung hole, an adapter is used. A locking bar means 32 extends between the pair of closure members 14 and comprises a pair of substantially identical generally flat bars 34 (see also FIGS. 5 and 6), each having a flanged end 36 with a slot 38, and a reduced width portion 40 adjacent the other end 42. As an alternative, the end 36 of a bar can be formed as illustrated in FIG. 5A, wherein a rounded or balled portion 40A separates a pair of reduced width portions 40B and 40C. Inwardly of the reduced width portion 40, each bar 34 is provided with an opening 44 having a generally uniform width, a figure eight shape or a reduced waisted shape, so as to be loosely received over a lug.

The bars 34 are just slightly smaller in section than the slotted portion 24 of the openings 20 in the lugs 18 , so as to fit therethrough, but wider than the diameter of the circular portion 22 of the openings 20 in the lugs 18, so as to be non-removable when turned as shown in FIG. 2.

As can be seen from FIG. 1, the bars 34 telescope, each bar 34 fits through the slot 38 of the other bar, so that the length of the bar means 32 is adjustable. By turning the bar means 32, the spade-like end 42 fits through the slot part 24 of the opening 20 of a lug 18 and when a reduced portion is within the lug's opening 20, the bar means is rotated in the opposite direction back to its initial relationship with the drum and the lugs, locking it with respect to that lug. The opening 44 in the opposite end 32, because of its size and shape can be slipped over the other lug without having the lugs precisely aligned in parallel relationship. The shackle 46 of a padlock 48 is passed through the lug opening 44 and above the bar means and the padlock is locked, thus locking the lugs 18 against removal from the drum.

Figure 5:
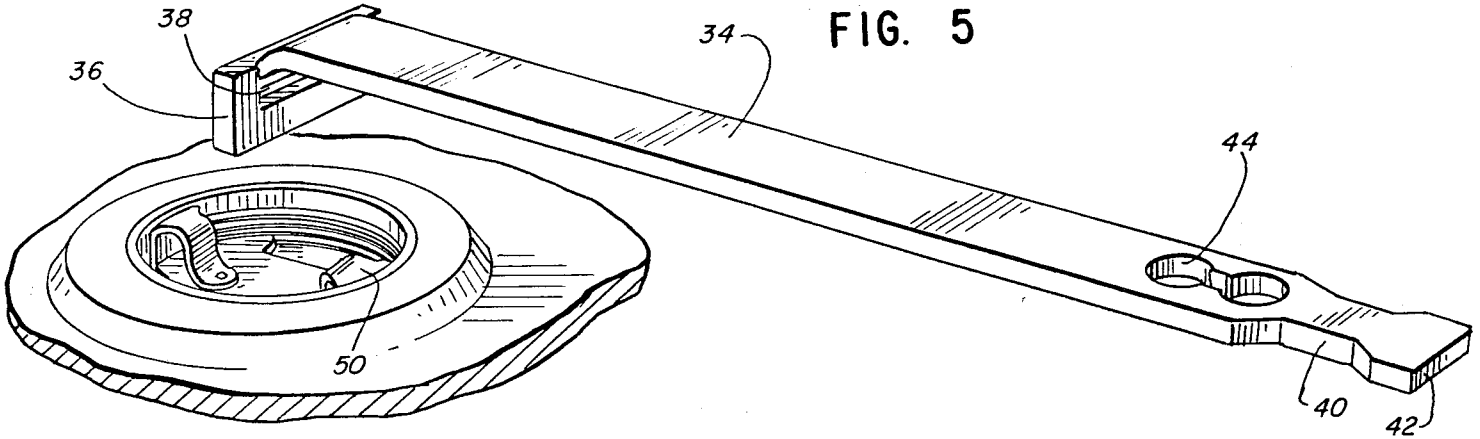
FIG. 5 is an illustration of a locking bar and indicating its use as a wrench for tightening or removing a bung plug or bung plug adapter.
Figure 5A:
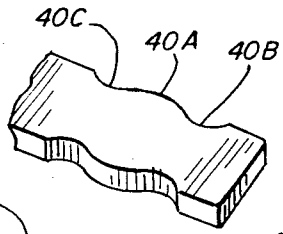
FIG. 5A is a partial illustration of another form of a spade end of a locking bar.
Figure 6:
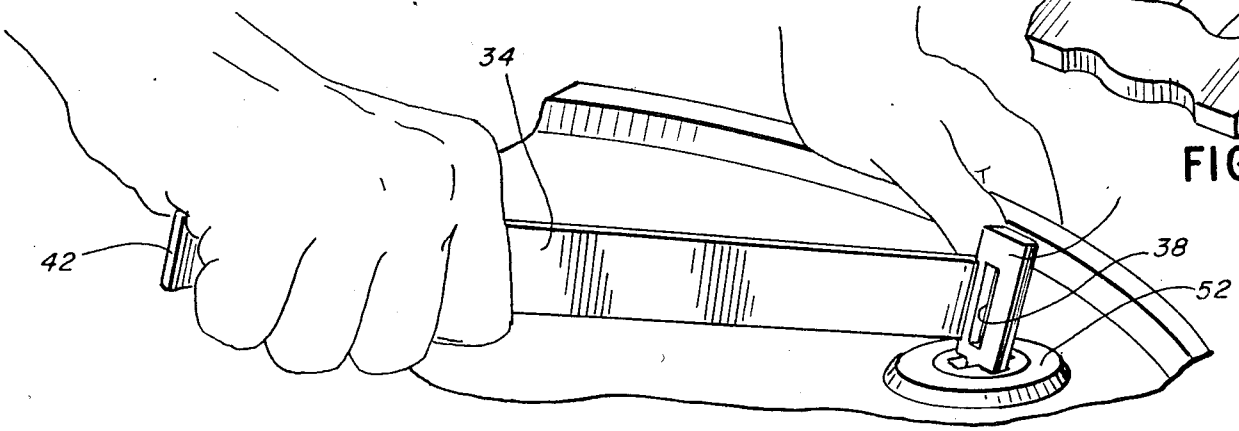
FIG. 6 is an illustration of using the locking bar as a wrench to remove or tighten a vent plug drum.

The usual, non-locking bung and vent plugs are illustrated in FIGS. 5 and 6, and are identified as 50 and 52, respectively. Each is so formed to receive a wrench means and to be tightened after insertion and to be loosened for removal from the drum. The locking bars 34 of this invention are formed at their flanged ends 36 with generally flat portions of a size and shape to be usuable as wrenches when removing or tightening the bung and vent plugs 50 and 52, as illustrated in FIGS. 5 and 6.

The locking bars 34 are generally formed by conventional metal working operations from flat metal. The closure members are formed by joining the lug portion to threaded closure members. Without departing from the spirit of the invention, the lugged closure members can be made of one piece of metal. In the event that the drum's contents are corrosive, the threads of the lugged closure members as well as those of any adapter members can be coated with or made of a corrosion resistant material. The closure adapters can be manufactured to provide a cup-like threaded receptacle for the lugged closure members as illustrated in FIG. 4, or can be made with a threaded opening therethrough. The closure adapters can be manufactured of metal or of a suitable plastic.

The appended claims are intended to cover all reasonable equivalents and are to be interpreted as broadly as the prior art will permit.

I claim:

1. A locking device for a container having a pair of threaded openings comprising:
   - a pair of closure means, each being threaded to be received in one of said threaded openings;
   - each closure means having an upstanding lug with an opening therethrough;
   - a pair of interfitting bar members, each having an end and a portion of a different width closely adjacent to said end and an opening therethrough adjacent said end, the different width portion of one member being received in the opening of one of said lugs, and the opening of said other member fitting over the other of said lugs; and
   - locking means engaging the opening of said other of said lugs.

2. A locking device as recited in claim 1, whereby one container opening is larger than the other container opening, and further comprising an adapter member threadably received in said larger container opening, said adapter member having a threaded part to threadably receive one of said closure means.

3. A locking device as recited in claim 1, wherein a reduced width portion of each interfitting bar member is defined by a spade end and said opening therethrough defines a bow tie or a figure eight shape.

4. A locking device as recited in claim 3, wherein said opening in each lug is defined by a slotted circle.

5. A locking device as recited in claim 1, wherein each bar member has a slot therein and a flanged end, each bar slot receiving the other bar member in telescoping relationship so as to be adjustable in length and adaptable for different container opening spacings.

6. A locking device as recited in claim 5, wherein each bar member is so constructed and arranged to be usable as a tool for removing the closure members.

7. A locking device as recited in claim 1, wherein each bar member is the same size and shape as the other bar member and is interchangeable therewith.

8. A locking device for a container having a first and a second threaded bung hole comprising:
   - a first and a second bung lug, each being threaded to be received in one of said threaded bung holes;
   - each bung lug having an upstanding portion with an opening therethrough;
   - a pair of telescoping locking bars, each having at least one reduced width portion and an opening therethrough adjacent their free ends, the reduced width portion of one locking bar being received in the opening of one of said lugs, and the opening of the other locking bar being received over the other of said lugs so that the opening of the last-named lug is free of said locking bar means;

each bar having a slot therein and a flanged end, each bar slot receiving the other bar in telescoping relationship and permitting the locking bars to be adjustable for different bung hole spacings; and locking means engaging the opening of said lug which is free of said locking bar.

9. A locking device as recited in claim 8, whereby one bung hole is larger than a vent hole, and further comprising an adapter closure member having a threaded part into which a bung lug is threadably received.

10. A locking device as recited in claim 8, wherein said reduced width portion of each telescoping bar is defined by a spade end and said opening therethrough is in the shape of a bow tie or a figure eight.

11. A locking device as recited in claim 8, wherein said opening in each lug is defined by a slotted circle.

12. A locking device as recited in claim 8, wherein each bar is formed from flat metal and each has its slotted end usable as a tool for screwing in and removing lugged bung hole closure members as well as the original bung hole plugs.

13. A method for locking bung holes of a container to prevent the removal of the container's contents comprising:

applying a flanged member to the bung hole closures, so as to remove said closures from the bung holes;

inserting a lugged closure member into each bung hole, each lugged closure member having an opening therethrough;

interfitting a pair of said flanged members, one end of each having a dfferent width portion and an opening therethrough, the different width portion of one flanged member being received in the opening of one of said lugs, and the opening of the other flanged member being received over the other lug so that its opening is free of said flanged member received thereover; and inserting a locking means through the opening of said last mentioned lug.

14. A method as recited in claim 13, wherein each flanged member has a slot therein and a flanged end, and inserting each flanged member through the slot in the other flanged member, so as to form a telescoping relationship of said flanged members which can be adjusted for different bung hole spacings.

* * * * *